US006823541B2

(12) United States Patent
Egan

(10) Patent No.: US 6,823,541 B2
(45) Date of Patent: Nov. 30, 2004

(54) PORTABLE SUPPORT APPARATUS AND METHOD

(76) Inventor: Thomas F. Egan, 570 Hance Rd., Binghamton, NY (US) 13903

( * ) Notice: Subject to any disclaimer, the term of this patent is extended or adjusted under 35 U.S.C. 154(b) by 0 days.

(21) Appl. No.: 09/921,299

(22) Filed: Aug. 3, 2001

(65) Prior Publication Data

US 2002/0069461 A1 Jun. 13, 2002

Related U.S. Application Data

(60) Provisional application No. 60/222,943, filed on Aug. 4, 2000.

(51) Int. Cl.[7] ..... A61G 7/08; A61G 7/10
(52) U.S. Cl. ..... 5/81.1 R; 5/86.1; 414/921
(58) Field of Search ..... 5/86.1, 81.1 R; 414/921; 254/93 H

(56) References Cited

U.S. PATENT DOCUMENTS 4,545,085 A * 10/1985 Feldt ..... 180/209
5,022,106 A * 6/1991 Richards ..... 4/254
5,193,633 A * 3/1993 Ezenwa ..... 180/65.1
5,502,851 A * 4/1996 Costello ..... 482/69
5,560,054 A * 10/1996 Simon ..... 5/83.1
5,639,105 A * 6/1997 Summo ..... 280/149.2
5,649,329 A * 7/1997 Horcher et al. ..... 5/83.1
5,682,630 A * 11/1997 Simon ..... 5/83.1
5,845,348 A * 12/1998 Dunn et al. ..... 5/83.1
5,987,664 A * 11/1999 Somerton et al. ..... 5/83.1
6,026,523 A * 2/2000 Simon et al. ..... 212/264
6,042,330 A * 3/2000 Egan ..... 212/237
6,223,364 B1 * 5/2001 Egan ..... 5/81.1 R
6,260,218 B1 * 7/2001 Tsuga ..... 5/86.1
6,289,534 B1 * 9/2001 Hakamiun et al. ..... 5/83.1
6,367,103 B1 * 4/2002 Collins ..... 5/83.1

* cited by examiner

*Primary Examiner*—J J Swann
*Assistant Examiner*—Katherine W Mitchell
(74) *Attorney, Agent, or Firm*—Thomas E. Anderson

(57) ABSTRACT

A portable support apparatus designed to support and transfer people with disabilities in a variety of environments. In a preferred embodiment, an apparatus in accordance with the present invention is realized as having two legs on a horizontal plane, containing four pivoting casters, pivoting along a vertical axis from a main cross member on a horizontal plane, a vertical support and handle pivoting about a horizontal axis, a locking pin to secure the vertical support when in the vertical position, attachment pins for supporting a portable patient lift or other device, and a motion-limiting device and interlock to constrain the movement of the lifting and transferring apparatus.

11 Claims, 6 Drawing Sheets

PORTABLE SUPPORT APPARATUS AND METHOD

CROSS-REFERENCE TO RELATED APPLICATIONS

This patent application claims priority to U.S. Provisional Patent Application No. 60/222,943, filed Aug. 4, 2000, which is hereby incorporated by reference herein in its entirety.

FIELD OF THE INVENTION

The present invention relates generally to devices and methods for lifting and transferring persons with disabilities and, more particularly, to a portable support apparatus and method.

BACKGROUND OF THE INVENTION

Difficulties are often encountered a disabled person transfers from one location to another whether independently or assisted. Particularly in the case of wheelchair-bound persons or persons with severe mobility impairments, it is often quite difficult to lift and transfer persons to and from their wheelchair when entering or exiting a motor vehicle or in any other desired transfer location.

There have been some inventive efforts directed at alleviating the problems associated with transferring disabled persons from one location to another via a portable hoist-type system. For example, U.S. Pat. Nos. 4,365,924 and 5,459,891 are both directed toward devices for transferring disabled persons.

The aforementioned disclose devices which allow a disabled person to be lifted and transferred. However, the devices disclosed in these patents, as well as other known devices, have drawbacks in the areas of limited portability and modularity which could limit the potential mobility of a disabled individual.

Although several of these products can be disassembled to a certain level, none demonstrates a high level of portability nor ease-of-use.

In view of the foregoing, it would be desirable to provide a portable support apparatus for lifting and transferring devices designed to assist persons with disabilities when transferring from one location to another which overcomes the above-described inadequacies and shortcomings.

SUMMARY OF THE INVENTION

According to the present invention, a portable support apparatus and method is provided for assisting persons with disabilities when being lifted or transferred from one location to another. The present invention portable support apparatus has two legs pivoting about a substantially vertical axis from the ends of a main cross member limited in their motion by two locking pins and detent holes. To each end of the legs is attached a caster assembly pivoting about a substantially vertical axis. Attached to the main cross member via hinge means about a substantially horizontal axis, is a support and handle assembly containing mounting pins suitable for attachment of a lifting and transfer device.

In accordance with other aspects of the present invention, the support and handle assembly can be pivoted about a substantially horizontal axis such that the handle will align itself with recessed areas in between the casters at the end of the legs and the main supports of the legs when the legs are released by means of the leg locking pin, and adjusted to their inboard position detents. The end result of this action is to allow the user to lift the assembly by the handle without further need for adjustments or connections, and, using the casters on the opposite ends of the legs as functional wheels, easily push or pull the collapsed assembly without lifting its entire weight. The offset location of the caster axle and the width of the casters permit the casters to immediately center themselves such that, when pushed, the unit will track straight.

In accordance with further aspects of the present invention, the support and handle assembly incorporates a locking blade and corresponding pin attached to the main cross member which allows for convenient release and securement of the support and handle when moving from a substantially vertical orientation to a horizontal stowed position.

In accordance with still further aspects of the present invention, a motion-limiting device is provided which prevents articulated members of the lift system mounted on the present invention portable support apparatus from swinging too far to the right or to the left at any joint.

In accordance with still further aspects of the present invention, a motion-limiting device is provided which prevents a lifting and transferring apparatus mounted on the present invention portable support apparatus from swinging too far to the right or to the left.

In accordance with still further aspects of the present invention, an electrical interlock switch is integrated into the motion-limiting device to prevent the lift from being operated if the motion-limiting device is not properly installed.

The present invention will now be described in more detail with reference to exemplary embodiments thereof as shown in the appended drawings. While the present invention is described below with reference to preferred embodiments, it should be understood that the present invention is not limited thereto. Those of ordinary skill in the art having access to the teachings herein will recognize additional implementations, modifications, and embodiments, as well as other fields of use, which are within the scope of the present invention as disclosed and claimed herein, and with respect to which the present invention could be of significant utility.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF EXEMPLARY EMBODIMENT(S)

Figure 1:
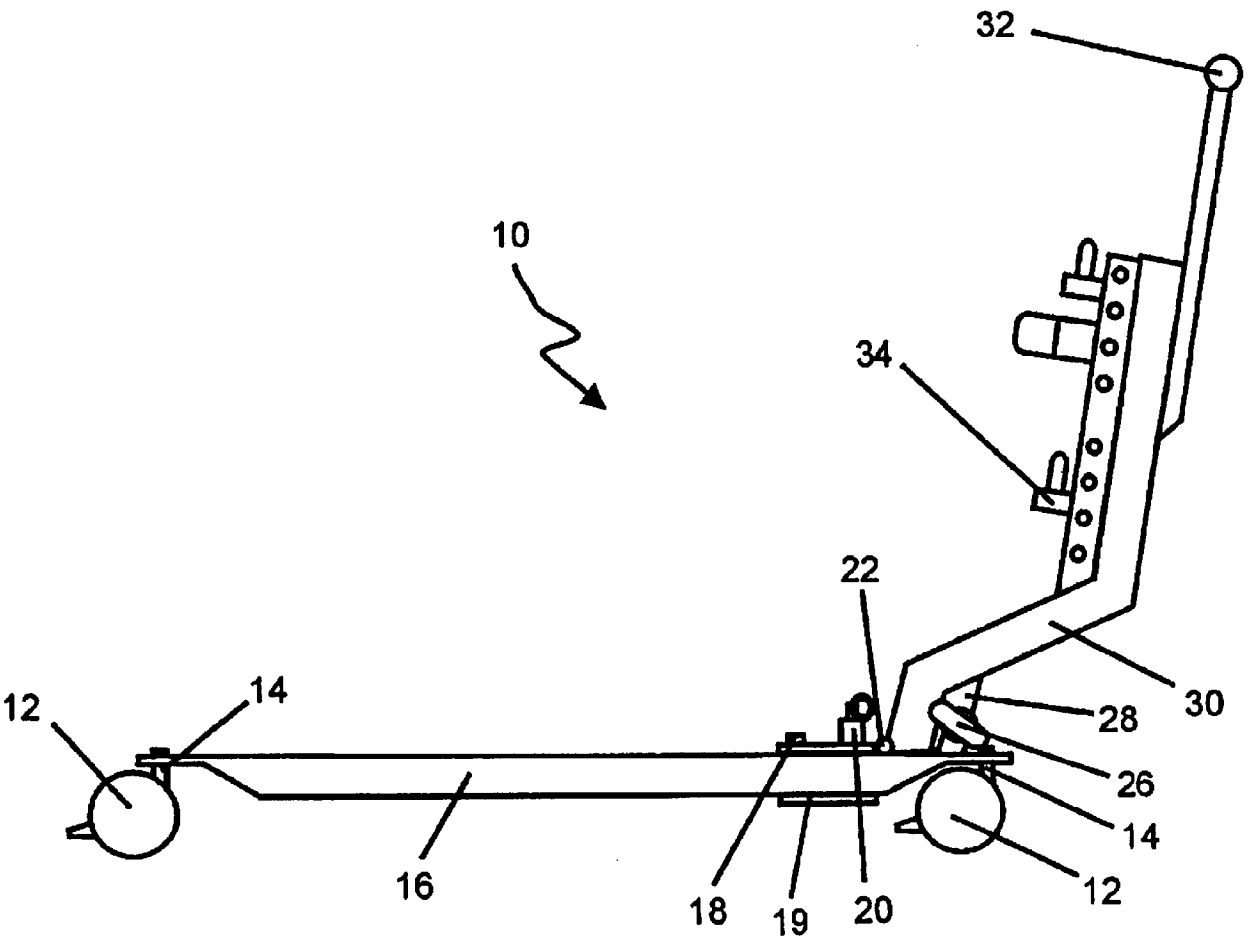
FIG. 1 is a side view of a portable support apparatus in accordance with the present invention with vertical support and handle assembly in vertical plane.
Figure 2:
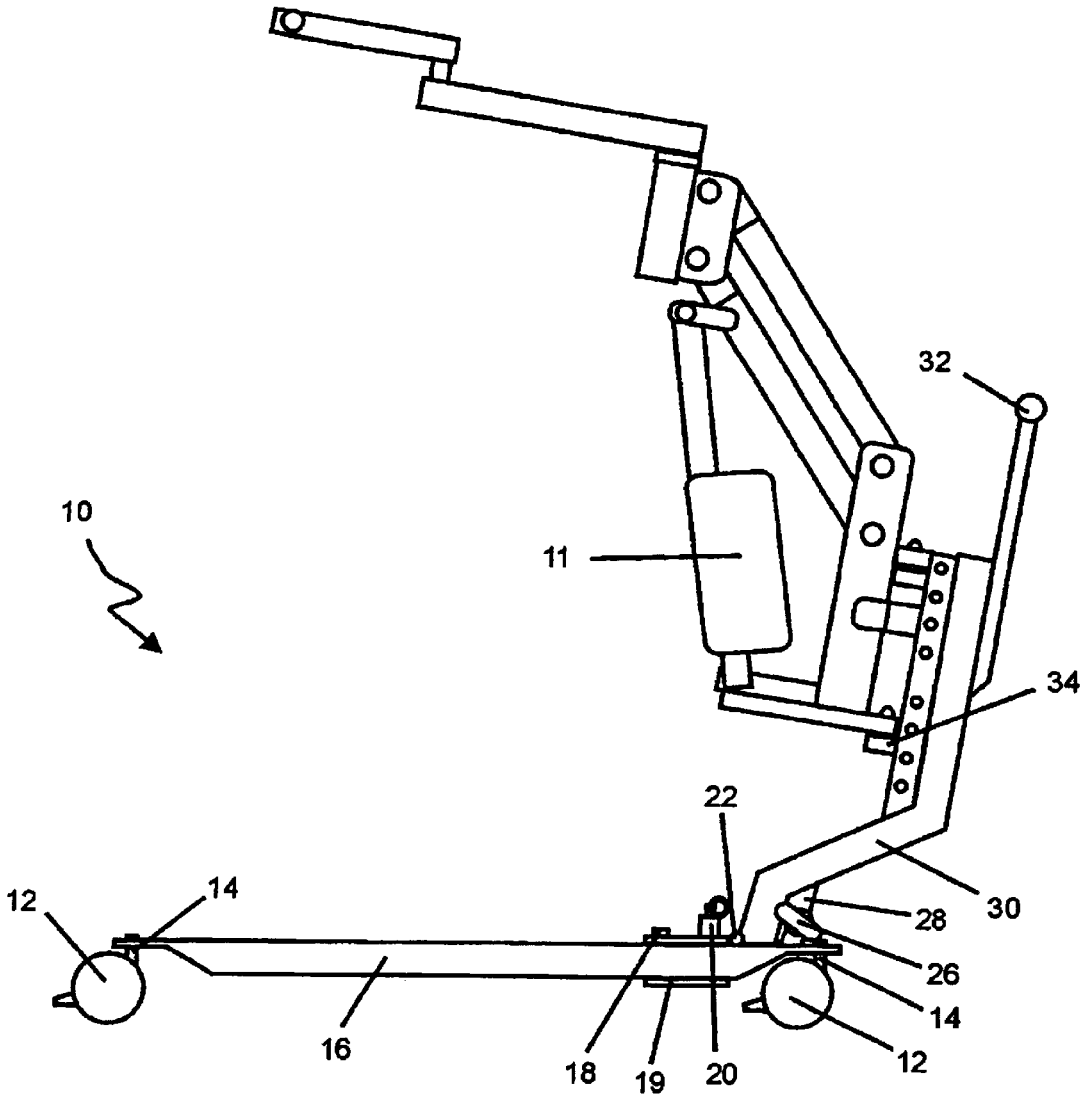
FIG. 2 is a side view of a portable support apparatus in accordance with the present invention with vertical support and handle assembly in vertical plane, and a sample lifting and transferring apparatus in place on support pins.
Figure 3:
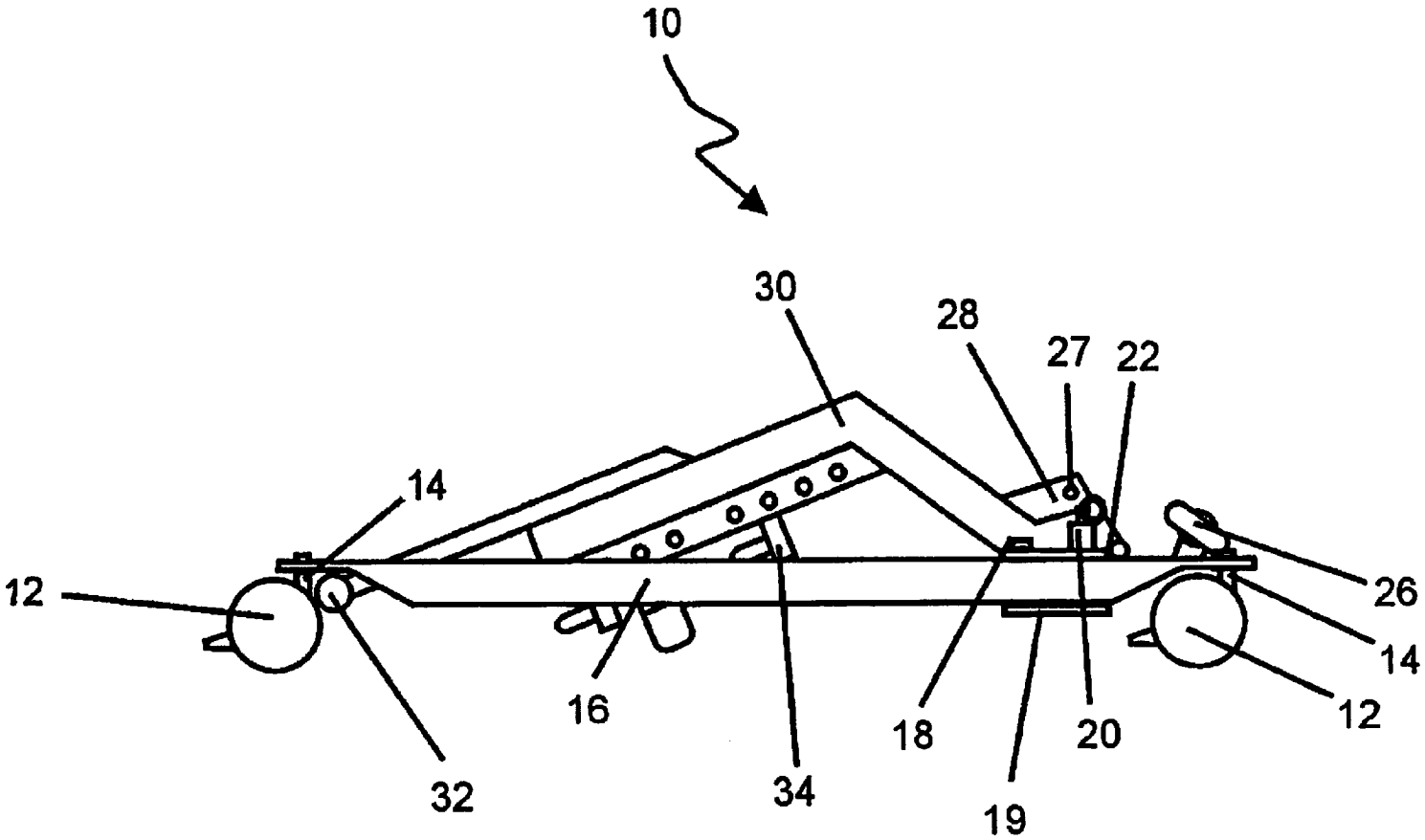
FIG. 3 is a side view of a portable support apparatus in accordance with the present invention with vertical support and handle assembly in horizontal plane.
Figure 4:
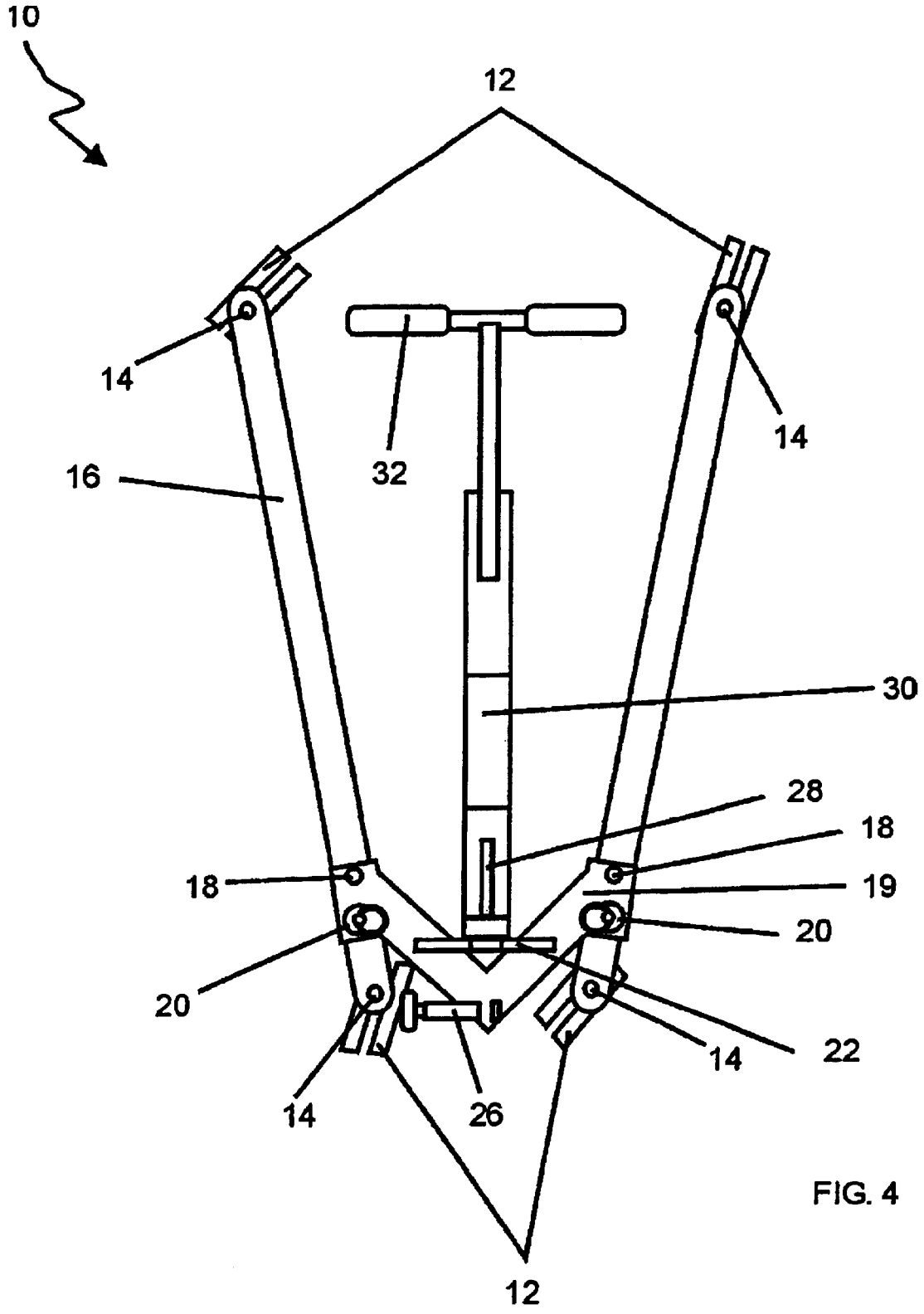
FIG. 4 is a top view of a portable support apparatus in accordance with the present invention with vertical support and handle assembly in horizontal plane with legs in outboard position.
Figure 5:
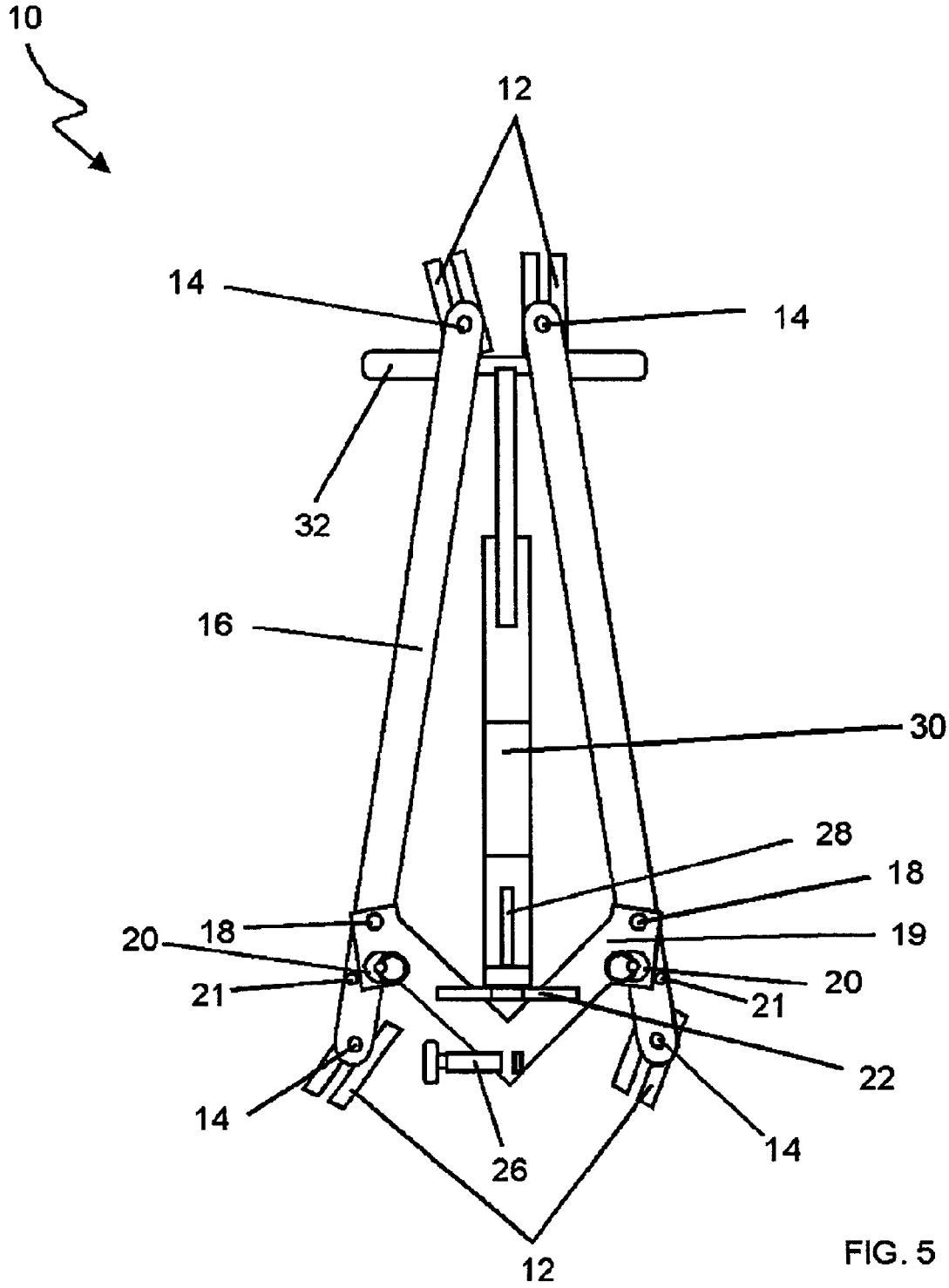
FIG. 5 is a top view of a portable support apparatus in accordance with the present invention with vertical support and handle assembly in horizontal plane with legs in outboard position.

Referring to FIGS. 1–5, there is shown a portable support apparatus 10 in accordance with the present invention in two respective positions. Beginning from the bottom of the apparatus 10 upward, the apparatus 10 includes a caster wheel assembly 12 secured to leg 16 by caster wheel assembly axle 14, which allows caster wheel assembly 12 to pivot about a substantially vertical axis. Leg 16 is secured to cross member 19 via leg axle 18, thus pivoting about a substantially vertical axis. The motion of leg 16 is limited by a combination of locking pin 20 located on cross member 19, and locating detent holes 21 (not visible, see FIG. 5).

It should be noted that the alignment of leg axle 18, leg locking pin 20 and locating detent holes 21 are such that the position of casters 12 and legs 16 will allow entry of handle 32 into the recess between casters 12 and the legs 16. It is important to note that this alignment is the factor which allows portable support apparatus 10 to be transported in a "hand truck style" movement.

Cross member 19 is connected to support and handle assembly 30 via support hinge 22, which is oriented on a substantially horizontal axis, allowing support and handle assembly 30 to pivot along a substantially vertical plane, with sufficient range of motion to rotate from a substantially vertical orientation in which locking pin 26 may engage hole 27 of locking blade 28 to a position below the plane of legs 16. Lift support pin assembly 34 is securely fastened to support and handle assembly 30 for purposes of supporting a variety of lifting and transferring apparatuses 11, such as for example the lifting and transferring apparatus disclosed in U.S. Pat. No. 6,042,330. It should be noted that lift support pin assembly 34 comprises a motion-limiting collar which prevents lifting and transferring apparatus 11 from undesirable sideward rotation and, thus, risk of tipping when the lift rotates to such position that the load center is outside the support base of portable support apparatus 10.

Figure 6:
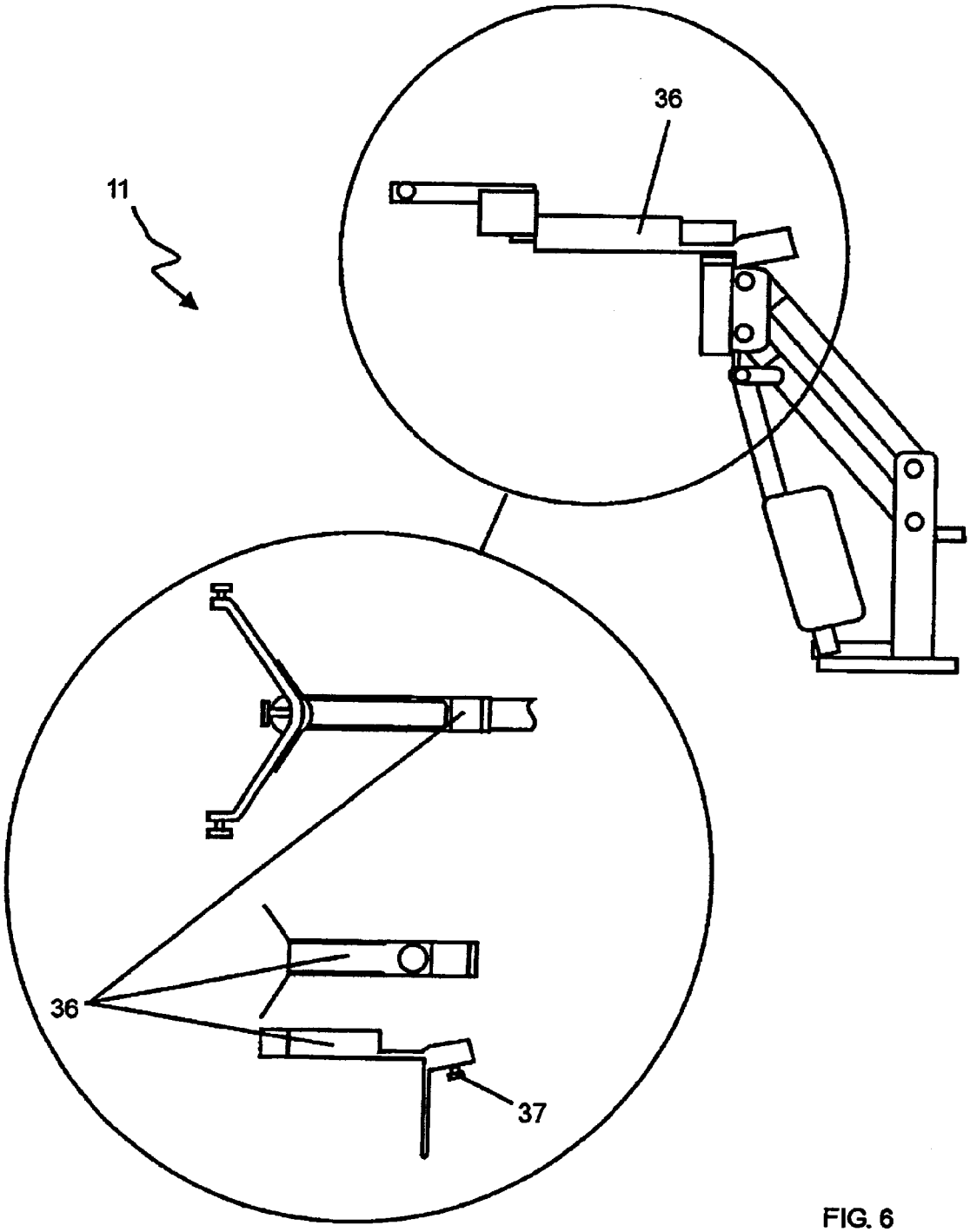
FIG. 6 is a side view of a sample lifting and transferring apparatus shown in FIG. 2 with articulation joint motion limiter installed. Additionally, side and top detail views of the motion limiter are provided.

Referring to FIG. 6, there is shown a lifting apparatus joint motion limiter 36 with lifting apparatus joint motion limiter interlock switch 37, incorporating top and side view detail drawings. Lifting apparatus joint motion limiter 36 can take a variety of forms, depending on the lifting apparatus being used in conjunction with portable support 10, however it will in all cases be inserted between two components of any articulation of the lifting and transferring apparatus in question in such manner as to immobilize the joint into which it is inserted by means of a combination of tongues and/or receiver channels into which the articulated elements of the lifting and transferring apparatus can be placed.

It should be additionally noted that lifting apparatus joint motion limiter interlock switch 37 is positioned to rest against components of lifting and transferring apparatus 11 only when placed in a proper and secure position to reliably immobilize the motion of the joint or joints it is designed to limit. Lifting apparatus joint motion limiter interlock switch 37 provides a de-activation signal to power supply such that power would be cut off in case of improper placement of lifting apparatus joint motion limiter 36, thus providing an important safety measure for portable support apparatus 10.

The present invention is not to be limited in scope by the specific embodiments described herein. Indeed, various modifications of the present invention, in addition to those described herein will be apparent to those of skill in the art from the foregoing description and accompanying drawings. Thus, such modifications are intended to fall within the scope of the appended claims.

What is claimed is:

1. A portable support apparatus comprising:

a main cross member having a first end and a second end;

a first leg and a second leg each having a first end and a second end, the first leg pivoting near a first end thereof about a substantially vertical axis at the first end of the main cross member, the second leg pivoting near a first end thereof about a substantially vertical axis at the second end of the main cross member;

a plurality of caster assemblies attached to the first and second legs, each of the plurality of caster assemblies pivoting about a substantially vertical axis; and a support and handle assembly directly attached to the main cross member via hinge means for pivoting about a substantially horizontal axis between a substantially vertical position and a substantially horizontal position.

2. The portable support apparatus of claim 1, wherein the support and handle assembly is configured to receive a modular powered lifting means.

3. The portable support apparatus of claim 1, wherein the first and second legs are limited in their motion by a pair of locking pins and detent holes formed in the first and second legs and the main cross member.

4. The portable support apparatus of claim 1, wherein a portion of the support and handle assembly engages with the first and second legs when in the substantially horizontal position for easy stowage and transport.

5. The portable support apparatus of claim 1, wherein the support and handle assembly is configured to receive the modular powered lifting means by comprising mounting pins that are suitable for removable attachment of the modular powered lifting means.

6. The portable support apparatus of claim 5, wherein the support and handle assembly comprises a substantial offset having a first substantially vertical portion attached to the main cross member via hinge means, an intermediate portion having a horizontal component connected to the first substantially vertical portion so as to substantially pass over the first ends of the first leg and the second leg when the support and handle assembly is in the substantially vertical position, and vertical portion connected to the substantially horizontal intermediate portion, such that a load on the attached modular powered lifting means may be safely supported by the portable support apparatus and the dimensions of the portable support apparatus may be reduced.

7. The portable support apparatus of claim 6, further comprising:

a motion-limiting assembly for attachment to the attached modular powered lifting means for preventing the load on the attached modular powered lifting means from moving unsafely outward of the plurality of caster assemblies.

8. The portable support apparatus of claim 7, further comprising:

an electrical interlock switch for preventing the attached modular powered lifting means from operating if the motion-limiting assembly is not properly installed.

9. The portable support apparatus of claim 5, wherein the support and handle assembly comprises means for adjusting the vertical location of the mounting pins.

10. The portable support apparatus of claim 1, further comprising:

locking means formed on the support and handle assembly and the main cross member for securing the support and handle assembly in the substantially vertical position.

11. The portable support apparatus of claim 10, wherein the locking means comprises a locking pin assembly formed on the main cross member for engaging with a locking blade formed on the support and handle assembly.

* * * * *